US008165497B2

(12) United States Patent
Fujii

(10) Patent No.: US 8,165,497 B2
(45) Date of Patent: Apr. 24, 2012

(54) DEVELOPER STORING APPARATUS, IMAGE FORMING UNIT AND IMAGE FORMING APPARATUS

(75) Inventor: Masashi Fujii, Tokyo (JP)

(73) Assignee: Oki Data Corporation, Tokyo (JP)

( * ) Notice: Subject to any disclaimer, the term of this patent is extended or adjusted under 35 U.S.C. 154(b) by 435 days.

(21) Appl. No.: 12/382,893

(22) Filed: Mar. 26, 2009

(65) Prior Publication Data

US 2009/0257781 A1 Oct. 15, 2009

(30) Foreign Application Priority Data

Apr. 9, 2008 (JP) ..... 2008-101562

(51) Int. Cl.

| | |
|---|---|
| ***G03G 15/06*** | (2006.01) |
| ***G03G 15/08*** | (2006.01) |
| ***G03G 21/00*** | (2006.01) |
| ***G03G 21/10*** | (2006.01) |

(52) U.S. Cl. ..... 399/120; 399/256; 399/263

(58) Field of Classification Search ..... 399/119, 399/120, 256, 263

See application file for complete search history.

(56) References Cited

U.S. PATENT DOCUMENTS

| | | | | |
|---|---|---|---|---|
| 4,967,234 | A * | 10/1990 | Tani et al. | 399/13 |
| 4,980,724 | A * | 12/1990 | Tanaka | 399/256 |
| 5,510,883 | A * | 4/1996 | Kimura et al. | 399/256 |
| 5,953,567 | A * | 9/1999 | Muramatsu et al. | 399/256 |
| 6,405,010 | B2 * | 6/2002 | Ashikari et al. | 399/262 |
| 7,248,823 | B2 * | 7/2007 | Buhay-Kettelkamp et al. | 399/254 |
| 7,263,325 | B2 * | 8/2007 | Marin et al. | 399/358 |
| 7,272,346 | B2 * | 9/2007 | Ito | 399/263 |
| 7,311,438 | B2 * | 12/2007 | Kim et al. | 366/295 |
| 7,319,828 | B2 * | 1/2008 | Takesawa et al. | 399/27 |
| 7,426,361 | B2 * | 9/2008 | Thompson et al. | 399/254 |
| 7,558,513 | B2 * | 7/2009 | Sugimoto et al. | 399/254 |

FOREIGN PATENT DOCUMENTS

| | | | |
|---|---|---|---|
| JP | 59-66253 | | 5/1984 |
| JP | 05197290 | A * | 8/1993 |
| JP | 06035317 | A * | 2/1994 |
| JP | 06208295 | A * | 7/1994 |
| JP | 2000-162945 | | 6/2000 |
| JP | 2001-42615 | | 2/2001 |
| JP | 2004-353915 | | 12/2004 |
| JP | 2006-162941 | | 6/2006 |

* cited by examiner

*Primary Examiner* — David Gray
*Assistant Examiner* — Fred L Braun
(74) *Attorney, Agent, or Firm* — Rabin & Berdo, P.C.

(57) ABSTRACT

A developer storing apparatus which includes a developer storing portion for receiving and storing a developer. The developer storing apparatus also includes a developer carrying member including a rotary shaft and a spiral blade rotatably disposed in the developer storing portion and configured to carry the developer in the developer storing portion in a predetermined direction, an agitating member extending outside the spiral blade rotatably disposed in the developer storing portion and configured to agitate the developer in the developer storing portion, and a driving force transmitting portion that transmits a driving force to the developer carrying member.

14 Claims, 13 Drawing Sheets

DEVELOPER STORING APPARATUS, IMAGE FORMING UNIT AND IMAGE FORMING APPARATUS

BACKGROUND OF THE INVENTION

The present invention relates to an image forming apparatus, and particularly relates to a developer storing apparatus for storing a developer.

In an image forming apparatus, a developer remaining on a surface of an image bearing body after a transferring process is scraped therefrom by a cleaning blade. The scraped developer (i.e., a waste developer) is stored in a developer storing apparatus. In the developer storing apparatus, a carrying unit carries the waste developer in a predetermined direction. As the amount of the waste toner stored in the developer storing apparatus increases, the carrying unit stops carrying the waste developer due to a load applied thereto by the waste developer. See, for example, Japanese Laid-Open Patent Publication No. 2006-162941 (paragraphs 0042-0051, FIG. 8).

However, there is a demand for a developer storing apparatus capable of storing a sufficient amount of developer.

SUMMARY OF THE INVENTION

The present invention is intended to provide a developer storing apparatus, an image forming unit and an image forming apparatus capable of storing a sufficient amount of developer.

The present invention provides a developer storing apparatus including a developer storing portion for receiving and storing a developer, a developer carrying member rotatably disposed in the developer storing portion and configured to carry the developer in the developer storing portion in a predetermined direction, an agitating member rotatably disposed in the developer storing portion and configured to agitate the developer in the developer storing portion, and a driving force transmitting portion that transmits a driving force to the developer carrying member.

With such an arrangement, it becomes possible to store a sufficient amount of developer in the developer storing apparatus.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments and examples of the present invention will be described with reference to the attached drawings.

Embodiment 1

Figure 1:
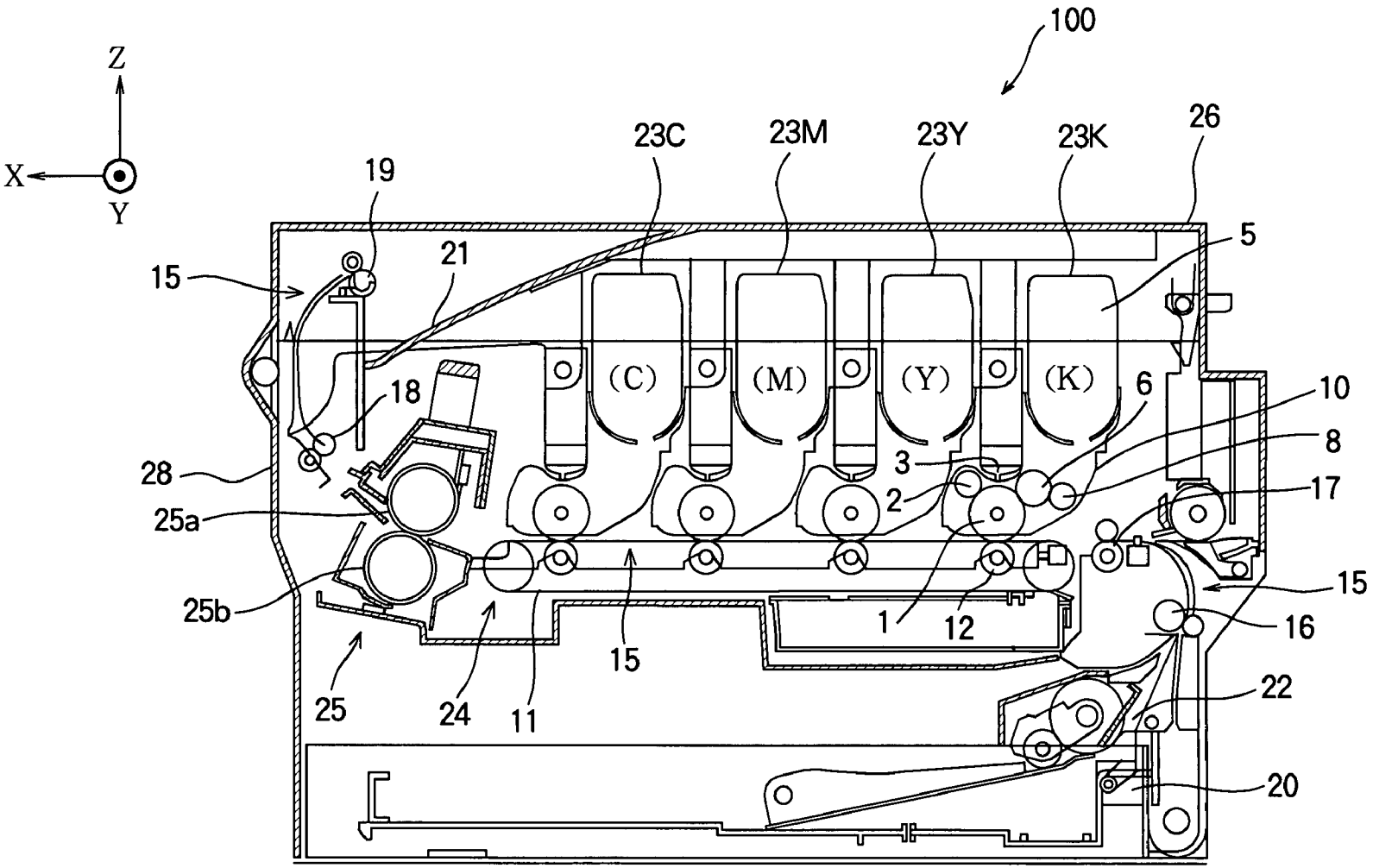
FIG. 1 is a side sectional view schematically showing a configuration of an image forming apparatus employing a toner cartridge according to Embodiment 1 of the present invention.

FIG. 1 is a side sectional view schematically showing a configuration of an image forming apparatus 100 employing a developer storing apparatus according to Embodiment 1 of the present invention.

The image forming apparatus 100 is configured as a color electrophotographic printer capable of printing four colors of black (K), yellow (Y), magenta (M) and cyan (C). The image forming apparatus 100 includes a lower frame 28 and an upper frame 26 that constitute a casing of the image forming apparatus 100. A substantially S-shaped sheet feeding path 15 is defined in the lower frame 28. A sheet cassette 20 for storing recording medium (recording sheets) is detachably mounted to a lower part of the lower frame 28, which defines an upstream end of the sheet feeding path 15. A stacker 21 is formed on the upper frame 26, which defines a downstream end of the sheet feeding path 15.

A sheet feeding unit 22 is disposed in the vicinity of the sheet cassette 20. The sheet feeding unit 22 feeds the recording sheet out of the sheet cassette 20 into the sheet feeding path 15. Two pairs of sheet feeding rollers 16 and 17 are disposed on the downstream side of the sheet feeding unit 22. The sheet feeding rollers 16 feed the recording sheet having been fed out of the sheet cassette 20. The sheet feeding rollers 17 correct skew of the recording sheet, and further feed the recording sheet to a transfer belt unit 24 described below. The transfer belt unit 24 is disposed on the downstream side of the sheet feeding rollers 17. The transfer belt unit 24 includes a transfer belt 11 that electrostatically attracts the recording sheet and feeds the recording sheet.

Image forming units 23K, 23Y, 23M and 23C are disposed so as to face the transfer belt unit 24 in such a manner that the recording sheet is sandwiched between the image forming units 23K, 23Y, 23M and 23C and the transfer belt 11 of the transfer belt unit 24. The image forming units 23K, 23Y, 23M and 23C are arranged in this order from the upstream to the downstream along the sheet feeding path 15, and are detachably mounted to a main body of the image forming apparatus 100. The image forming units 23K, 23Y, 23M and 23C respectively form toner images (developer images) of black (K), yellow (Y), magenta (M) and cyan (C) on the recording sheet. The image forming units 23K, 23Y, 23M and 23C are collectively referred to as an image forming unit 23.

In FIG. 1, X-direction is defined as being parallel to a feeding direction of the recording sheet when the recording sheet 13 (FIG. 2) passes the image forming units 23K, 23Y, 23M and 23C. Y-direction is defined as being parallel to rotation axes of photosensitive bodies 1 (described later) of the image forming units 23K, 23Y, 23M and 23C. Z-direction is defined as being perpendicular to both of the X-direction and Y-direction. The X-direction, Y-direction and Z-direction in other figures indicate the same directions as shown in FIG. 1. In other words, the X-direction, Y-direction and Z-direction of the respective figures indicate orientations of respective parts shown in the figures when the parts constitute the image forming apparatus 100 shown in FIG. 1.

The image forming units 23K, 23Y, 23M and 23C have the same configurations except the toner, and therefore a configuration of the image forming unit 23K will be described below.

Figure 2:
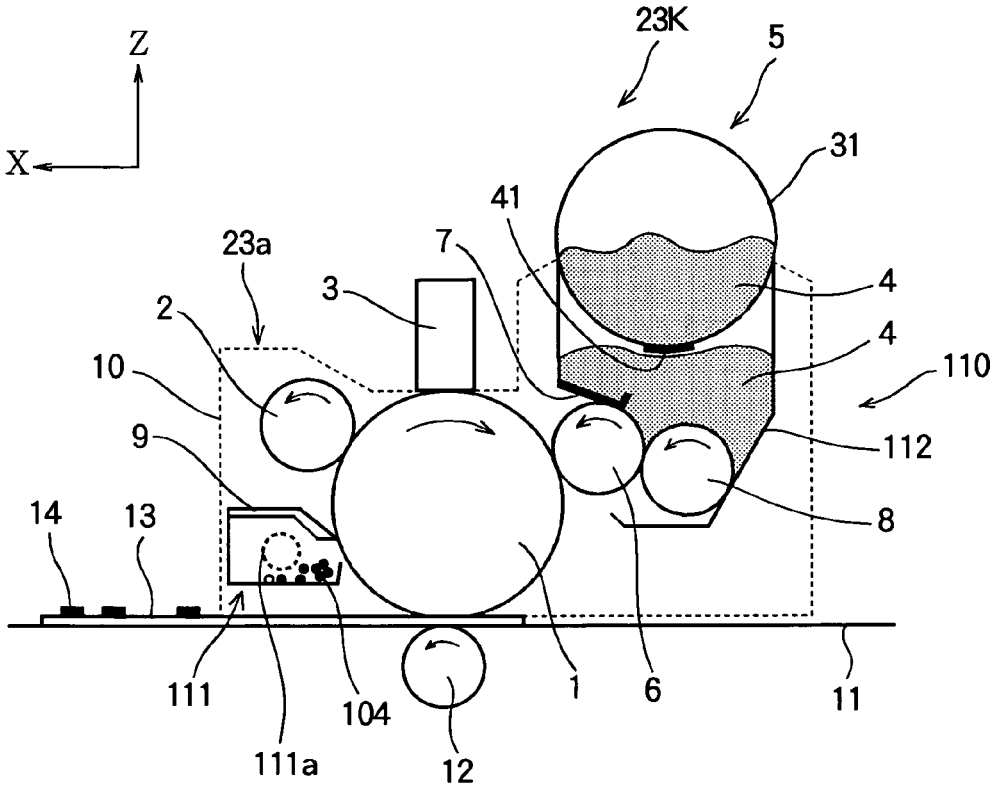
FIG. 2 is an enlarged sectional view showing an image forming unit of black (K) together with a transfer roller, an exposing device and a recording medium according to Embodiment 1.
Figure 3:
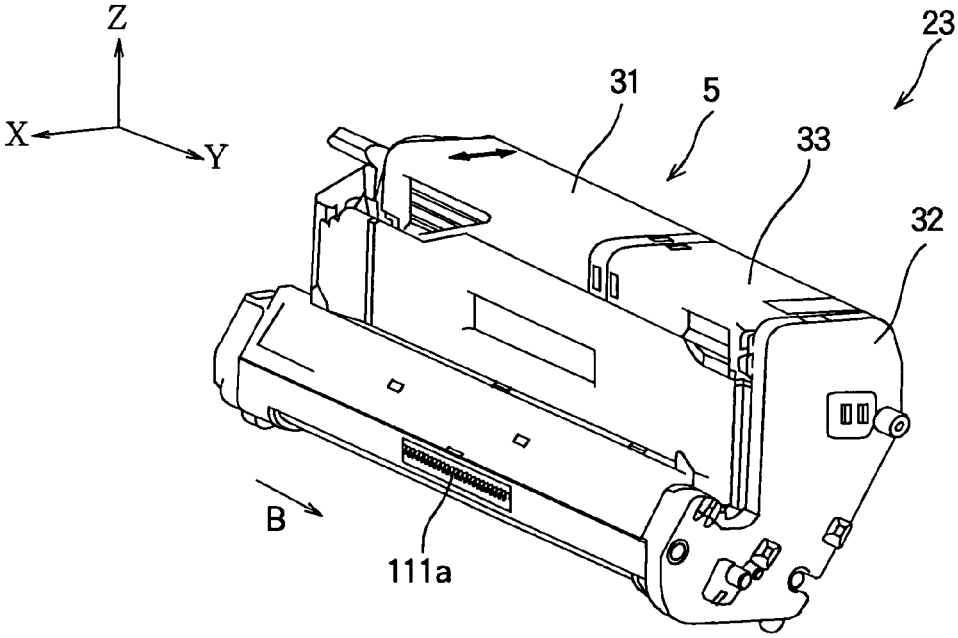
FIG. 3 is a perspective view showing the image forming unit according to Embodiment 1.

FIG. 2 is a schematic view showing the image forming unit 23K of black (K) together with a transfer roller 12, an exposing device 3 and a recording sheet 13. FIG. 3 is a perspective view showing the image forming unit 23.

As shown in FIG. 2, the image forming unit 23K includes a photosensitive body 1 that rotates in a direction shown by an arrow. A charging roller 2 and an exposing device 3 are disposed along a circumference of the photosensitive body 1 in a rotational direction of the photosensitive body 1. The charging roller 2 is pressed against the surface of the photosensitive body 1 with a constant pressure, and applies a voltage to the photosensitive body 1 to uniformly change the surface of the photosensitive body 1. The exposing device 3 includes, for example, an LED head and irradiates the surface of the photosensitive body 1 to form a latent image. In this regard, the exposing device 3 is mounted to the upper frame 26 (FIG. 1) of the image forming apparatus 100.

Further, a developing unit 110 and a cleaning blade 9 are disposed along the circumference of the photosensitive body 1. The developing unit 110 causes a toner of a predetermined color (in this example, black) to adhere to the surface of the photosensitive body 1 on which the latent image is formed, so as to develop the latent image. The cleaning blade 9 removes residual toner (that remains on the surface of the photosensitive body 1 after transferring of the toner image) from the surface of the photosensitive body 1 so that the toner falls in a waste toner collecting portion 111 described later. The cleaning blade 9 is made of resilient body, and an edge portion of the cleaning blade 9 is pressed against the surface of the photosensitive body 1 with a predetermined contact pressure. A waste toner carrying member 111*a* composed of a spiral or coil spring is disposed in the waste toner collecting portion 111. The waste toner carrying member 111 carries a waste toner 104 (i.e., the residual toner fallen from the photosensitive body 1) in a predetermined direction as described later. Among the above described components, rotating bodies are rotated by driving forces transmitted from not shown driving sources via gears or the like.

The developing unit 110 includes a toner cartridge 5 (i.e., a developer storing apparatus) including a toner supplying portion 31 configured to store unused toner 4 therein and to supply the toner 4 via a toner supplying opening 41 formed on a lower part of the toner storing portion 31. The developing unit 110 further includes a toner reservoir portion 112 for reserving the toner 4 supplied by the toner supplying portion 31, a developing roller 6 disposed so as to contact the photosensitive body 1, a toner supplying roller 8 that supplies the toner 4 to the developing roller 6, and a developing blade 7 that forms a uniform thin layer of the toner 4 on the surface of the developing roller 6. With such a configuration, the developing unit 110 causes the toner 4 on the surface of the developing roller 6 to adhere to the latent image on the photosensitive drum 1, so as to develop (visualize) the latent image. The developing roller 6, the toner supplying roller 8 and the developing blade 7 are respectively connected to a developing roller power source, a supplying roller power source and a developing blade power source (not shown), and are applied with respective bias voltages.

The toner cartridge 5 is detachably attached to a portion of the image forming unit 23K above the toner supplying roller 8. A part of the image forming unit 23 except the toner cartridge 5 is referred to as an image forming unit main body 23*a*. The image forming unit main body 23*a* is enclosed by a casing 10. The toner cartridge 5 is mounted on the casing 10 so as to supply the toner 4 to the image forming unit main body 23*a*. The image forming unit main body 23*a* has a toner replenishing opening (not shown) disposed corresponding to the toner supplying opening 41, so as to receive the toner supplied by the toner cartridge 5.

The developing roller 6 and the toner supplying roller 8 are disposed parallel to each other. The developing roller 6 and the toner supplying roller 8 are pressed against each other with a predetermined pressure, and rotate in the same directions as shown by arrows in FIG. 2. The developing blade 7 and the developing roller 6 are disposed parallel to each other, and contacts each other so that, for example, a bent portion of the developing blade 7 contacts the circumferential surface of the developing roller 6 with a contact pressure.

As shown in FIG. 1, transfer rollers 12 are disposed so as to face the respective photosensitive bodies 1 of the image forming units 23K, 23Y, 23M and 23C. The transfer rollers 12 are pressed against the photosensitive bodies 1 via the transfer belt 11 that attracts and feeds the recording sheet 13 (FIG. 2). The transfer rollers 12 are composed of conductive rubber or the like. The transfer rollers 12 are applied with bias voltages so as to generate electric potential differences between the transfer rollers 12 and the photosensitive bodies 1. With the electric potential differences, the toner images on the photosensitive bodies 1 are transferred to the recording sheet 13 (FIG. 2).

The fixing unit 25 (FIG. 1) includes a heat roller 25*a* and a backup roller 25*b* configured to sandwich the recording sheet 13 (on which the toner image has been transferred by the image forming units 23 and the transfer rollers 12). The heat roller 25*a* and the backup roller 25*b* apply heat and pressure to the toner image, so as to fix the toner image to the recording sheet 13.

Two pairs of sheet feeing rollers 18 and 19 are disposed on the downstream side of the fixing unit 25 along the sheet feeding path 15. The sheet feeing rollers 18 and 19 feed the recording sheet 13 with the toner image having been fixed, and eject the recording sheet 13 to the stacker 21.

As shown in FIG. 3, the toner cartridge 5 includes the toner supplying portion 31 that stores the unused toner 4. The toner cartridge 5 further includes a toner storing portion 33 (i.e., a developer storing portion) that stores the waste toner 104 having fallen into the waste toner collecting portion 111 and having been carried by a not shown carrying unit (including the waste toner carrying member 111*a*). The toner storing portion 33 and the toner supplying portion 31 are disposed adjacent to each other. In FIG. 3, the image forming unit 23 is illustrated in such a manner that a part of the image forming unit 23 is cutout for partially showing the waste toner carrying member 111*a* disposed in the waste toner collecting portion 111.

The waste toner 104 adhering to the photosensitive body 1 is removed therefrom by the cleaning blade 9, and falls into the waste toner collecting portion 111. Then, the waste toner 104 is carried by the waste toner carrying member 111*a* in the direction shown by arrow B (FIG. 3), and is carried to a side frame 32 of the image forming unit 23. Then, a carrying belt (not shown) disposed in the side frame 32 carries the waste toner 104 to a toner collection opening 33*a* (FIG. 4) disposed in the toner storing portion 33 described later, and is stored in the toner storing portion 33.

Figure 4:
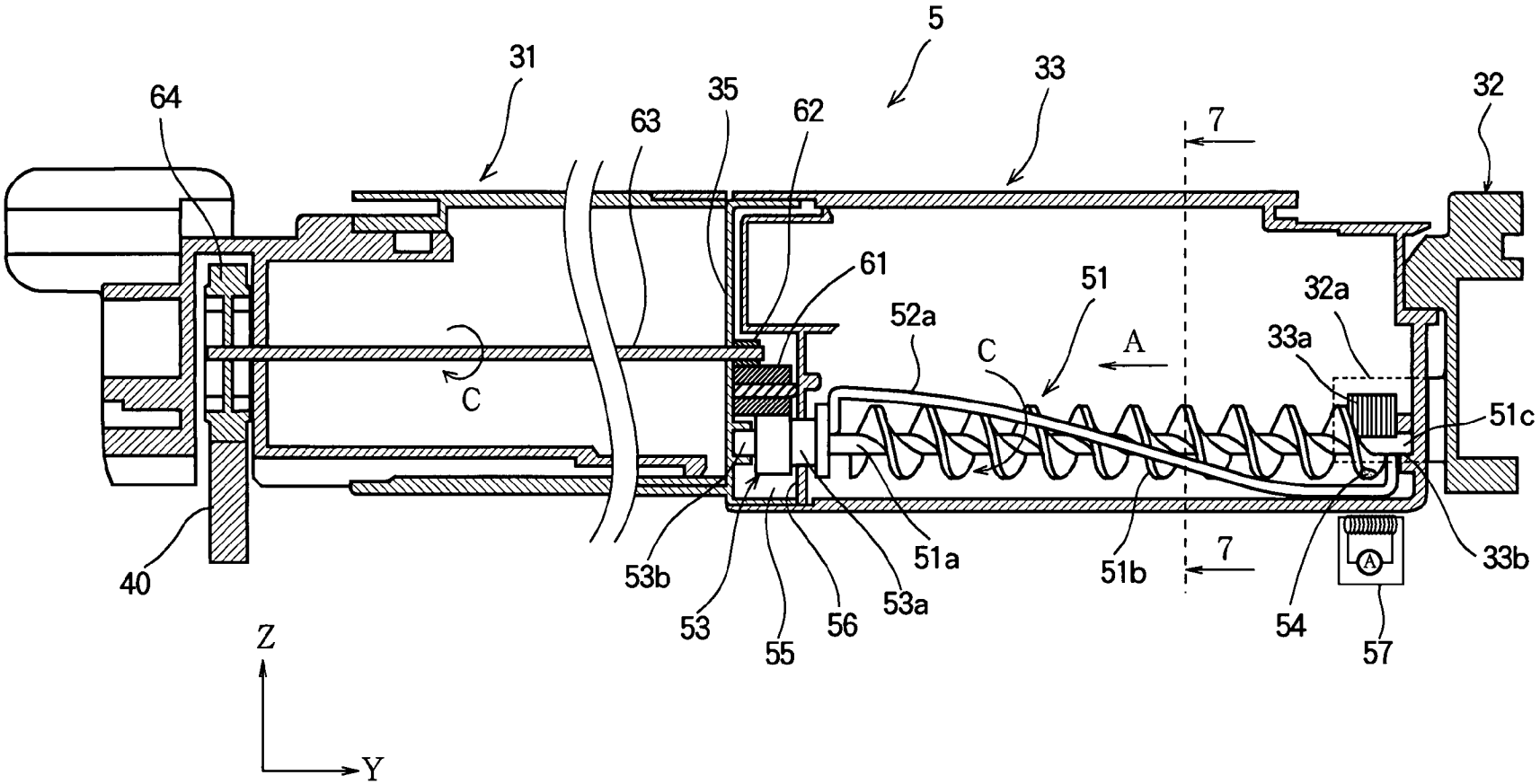
FIG. 4 is a longitudinal sectional view showing a toner cartridge according to Embodiment 1.

FIG. 4 is a longitudinal sectional view showing a configuration of the toner cartridge 5 including the toner storing portion 33 according to Embodiment 1.

As shown in FIG. 4, the toner cartridge 5 (i.e., the developer storing apparatus) includes the above described toner supplying portion 31 and the toner storing portion 33 which are adjacent to each other via a center partition wall 35. A toner carrying member 51 is disposed at a lower part inside the toner storing portion 33. A receiving portion (not shown) is disposed in the toner storing portion 33. The receiving portion has a substantially cylindrical shape and the toner collection opening 33*a* is formed thereon. A toner ejecting portion 32*a* of the side frame 32 is fit into the receiving portion when the toner cartridge 5 is mounted to the image forming unit main body 23*a*. The waste toner 104 having been carried by the above described carrying belt or the like is supplied to the toner storing portion 33 via the toner collection opening 33*a* of the receiving portion.

Figure 5A:
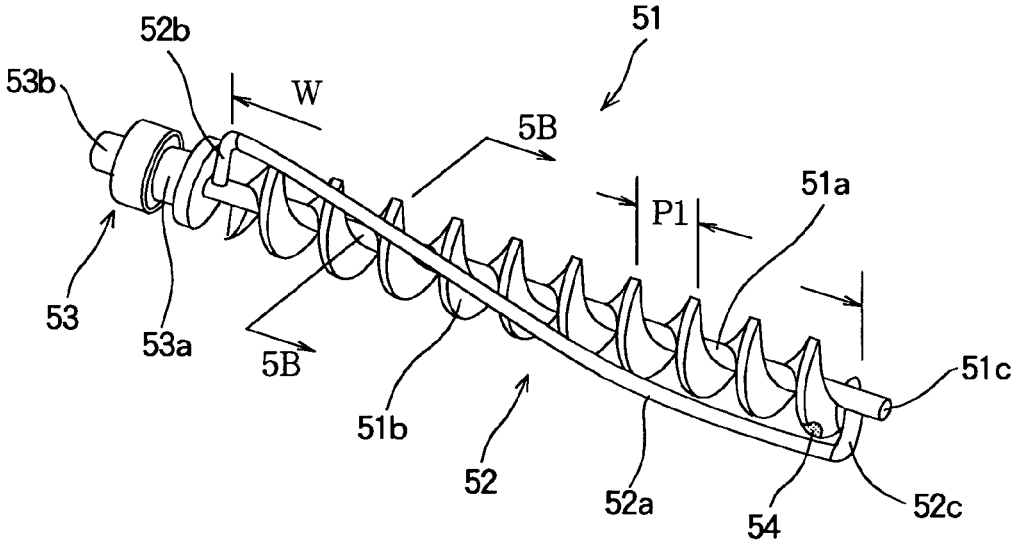
FIG. 5A is a perspective view showing a toner carrying member according to Embodiment 1.
Figure 5B:
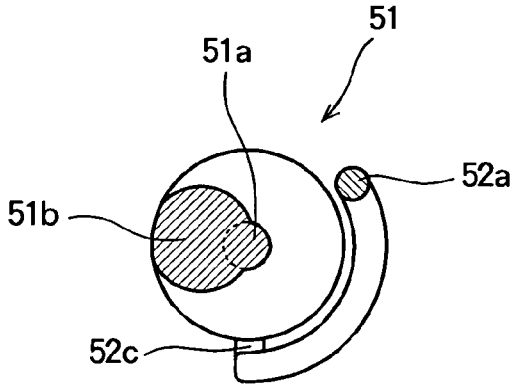
FIG. 5B is a sectional view taken along line 5B-5B in FIG. 5A.

FIG. 5A is a perspective view of the toner carrying member 51. FIG. 5B is a sectional view of the toner carrying member 51 taken along line 5B-5B in FIG. 5A.

As shown in FIGS. 5A and 5B, the toner carrying member 51 includes a shaft portion 51*a* (i.e., a rotation shaft), a spiral blade 51*b* formed in a spiral shape around the shaft portion 51*a* at a predetermined spiral pitch P1, a rotation gear 53 disposed on an end of the shaft portion 51*a* and an agitating member 52 fixed to the shaft portion 51*a*. Shaft-receiving rotating portions 53*a* and 53*b* are formed on both sides of the rotation gear 53 in an axial direction of the shaft portion 51*a*.

The agitating member 52 includes a pair of supporting portions 52*b* and 52*c* disposed in vicinities of both ends of the shaft portion 51*a*. The supporting portions 52*b* and 52*c* are shifted 180 degrees from each other in a rotational direction about the shaft portion 51*a*. The supporting portions 52*b* and 52*c* have predetermined heights from the shaft portion 51*a*, and extend in a radial direction of the shaft portion 51*a*. An agitating portion 52*a* (for example, in the form of a bar having a circular cross section) is supported by tips of the supporting portions 52*b* and 52*c*, and extends between the supporting portions 52*b* and 52*c* apart from the shaft portion 51*a*. To be more specific, the agitating portion 52*a* extends in a spiral shape around the shaft portion 51*a* about a half turn in the rotational direction about the shaft portion 51*a*. A magnet 54 (i.e., a to-be-detected portion) is disposed on an outer circumference of an endmost part of the spiral blade 51*b*. The magnet 54 is detected by a detecting unit as described later for detecting the rotation of the toner carrying member 51.

A spiral pitch P2 of the agitating portion 52*a* is expressed by P2=2×W, where W indicates a distance between the pair of supporting portions 52*b* and 52*c*. The heights of the supporting portions 52*b* and 52*c* are so set that the height of the agitating portion 52*a* from the shaft portion 51*a* is higher than the height of the spiral blade 51*b*.

As shown in FIG. 4, a frame 56 is disposed in the toner storing portion 33 so that the frame 56 and the center partition wall 35 form a gear box 55. The shaft-receiving rotating portions 53*b* and 53*a* of the toner carrying member 51 are rotatably supported by the center partition wall 35 and the frame 56. An end 51*c* of the toner carrying member 51 (opposite to the rotation gear 53) is rotatably supported by a shaft-receiving hole 33*b* formed on a side wall of the toner storing portion 33. With such a configuration, the toner carrying member 51 is rotatably supported in the toner storing portion 33 in such a manner that the shaft portion 51*a* is disposed below the toner collection opening 33*a*, and the rotation gear 53 is disposed in the gear box 55. Further, the toner carrying member 51 extends in the longitudinal direction of the toner storing portion 33 (i.e., the Y-direction) at the lower part of the toner storing portion 33 so that the end of the spiral blade 51*b* is disposed in the vicinity of the toner collection opening 33*a*.

A driving force transmitting shaft 63 (i.e., a driving force transmitting portion) penetrates through the toner supplying portion 31, and is rotatably supported by the center partition wall 35 and a side wall of the toner supplying opening 31. An end of the driving force transmitting shaft 63 penetrates through the center partition wall 35, and a coupling gear 62 is fixed to the end of the driving force transmitting shaft 63 in the gear box 55. The other end of the driving force transmitting shaft 63 penetrates through the side wall of the toner supplying portion 31, and a cartridge gear 64 is fixed to the end of the driving force transmitting shaft 63 outside the side wall of the toner supplying portion 31.

When the toner cartridge 5 is mounted to the image forming unit main body 23*a* (FIG. 2), the cartridge gear 64 engages a driving gear 40 disposed in the image forming unit main body 23*a*, and receives a driving force (via the driving gear 40) transmitted by the driving source (not shown) via a predetermined transmission path. With this driving force, the cartridge gear 64 rotates in a direction shown by arrow C, so that the driving force transmitting shaft 63 rotates in the same direction. Further, the above described coupling gear 62

(fixed to the end of the driving force transmitting shaft 63) engages an intermediate gear 61 rotatably supported in the gear box 55, and the intermediate gear 61 engages the rotation gear 53 of the toner carrying member 51. With such a configuration, the driving force transmitted from the driving source (not shown) is transmitted to the toner carrying member 51, so that the toner carrying member 51 is driven to rotate in the direction shown by arrow C at a predetermined timing. The rotation period of the toner carrying member 51 is, for example, approximately 0.8 seconds.

A rotation detecting unit 57 is disposed in the image forming unit main body 23*a* so as to face the outer surface of the toner storing portion 33. To be more specific, the rotation detecting unit 57 is disposed in the vicinity of a position where the magnet 54 on the endmost part of the spiral blade 51*b* periodically approaches as the toner carrying member 51 rotates in the direction shown by arrow C. The rotation detecting unit 57 detects change in magnetic field when the magnet 54 approaches to the rotation detecting unit 57, to thereby detect the rotation of the toner carrying member 51, and sends a rotation signal to an alarm control unit 151 (FIG. 6) described below.

Figure 6:
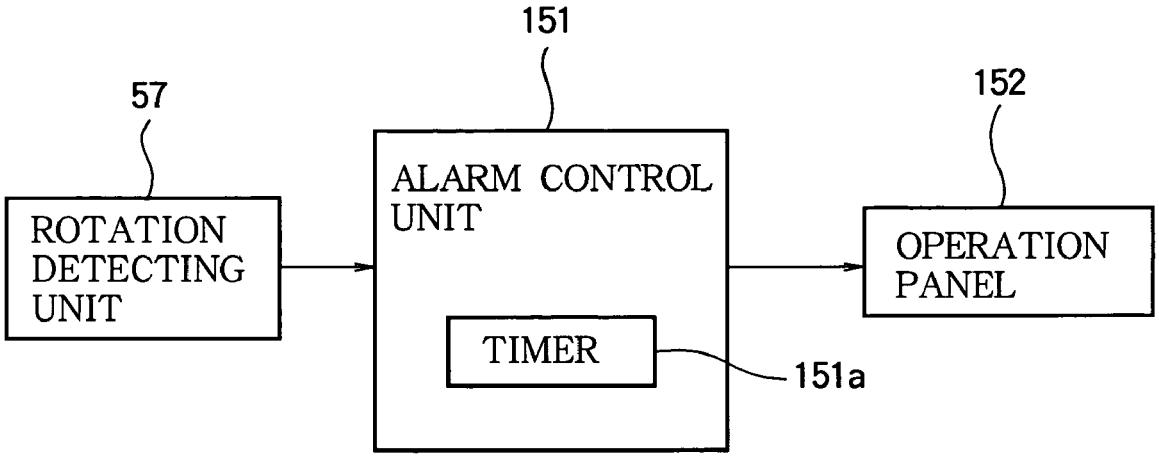
FIG. 6 is a block diagram showing a configuration of a rotation monitoring system including an alarm control unit according to Embodiment 1.

FIG. 6 is a block diagram of a rotation monitoring system including the alarm control unit 151. As shown in FIG. 6, the rotation monitoring system includes the above described rotation detecting unit 57, the alarm control unit 151 and an operation panel 152 disposed on a predetermined position on the image forming apparatus 100 so as to be visible to a user.

The rotation detecting unit 57 sends the rotation signal in synchronization with the rotation of the toner carrying member 51 (for example, a rotation synchronizing pulse signal) to the alarm control unit 151 as described above. The alarm control unit 151 resets a timer 151*a* (provided in the alarm control unit 151) to zero on receiving the rotation synchronizing pulse signal. If the timer 151*a* counts, for example, approximately 4.0 seconds (corresponding to five rotations of the toner carrying member 51) without being reset, the alarm control unit 151 determines that the toner storing portion 33 is filled with the waste toner 104, and sends instruction to the operation panel 152 to display a predetermined alarm message. Based on the instruction, the operation panel 152 causes a predetermined light emitting unit to flash, to notify the user that the toner storing portion 33 is in the filled state.

A printing operation of the image forming apparatus 100 will be described with reference to FIG. 1.

When the image forming apparatus 100 starts printing operation, the sheet feeing unit 22 picks up the recording sheet from the sheet cassette 20, and the sheet feeding rollers 16 and 17 feed the recording sheet along the sheet feeding path 15 to the transfer belt unit 24. While the transfer belt unit 24 feeds the recording sheet, the image forming units 23K, 23Y, 23M and 23C respectively form toner images, and the transfer rollers 12 respectively transfer the toner images to the recording sheet. Further, the fixing unit 25 fixes the toner image to the recording sheet, and then the sheet feeding rollers 18 and 19 eject the recording sheet (with the toner image having been fixed) to the stacker 21.

Next, an operation of the image forming unit 23 in the above described printing operation will be described with reference to FIGS. 2 and 3.

In the image forming unit 23, the toner supplying roller 8 supplies the toner 4 (supplied from the toner cartridge 5) to the developing roller 6. The developing blade 7 uniformly regulates a thickness of a layer of the toner 4 on the surface of the developing roller 6. The latent image formed on the photosensitive drum 1 by the exposing device 3 is developed with the toner 4 on the developing roller 6. The toner image formed on the photosensitive drum 1 is transferred to the recording medium 13 by the transfer belt 11 and the transfer rollers 12 due to electric potential difference.

The toner 4 that remains on the photosensitive drum 1 (without being transferred to the recording medium 13) is scraped therefrom by the cleaning blade 9, and is accumulated (as the waste toner 104) in the waste toner collecting portion 111. The waste toner 104 in the waste toner collecting portion 111 is carried by the waste toner carrying member 111*a* having a spiral shape in the waste toner collecting portion 111 in the direction shown by arrow B (FIG. 3) toward the side frame 32. Then, the waste toner 104 is carried by the carrying belt (not shown) in the form of a caterpillar belt in the side frame 32 to the toner collection opening 33*a* (FIG. 4) in the toner storing portion 33, and is stored in the toner storing portion 33 via the toner collection opening 33*a*.

In this regard, the waste toner 104 is applied with a stress when the waste toner 104 is scraped by the cleaning blade 9 or when the waste toner 104 is carried from the waste toner collecting portion 111 to the toner storing portion 33. Due to the stress, the waste toner 104 tends to be "softly agglomerated". A soft agglomeration will be herein descried.

A toner includes, for example, mother particles (containing polyester or acrylic-styrene-copolymer as binder resin) with particle diameter of approximately 5 to 8 μm and an external additive (such as silica, titania or alumina) with particle diameter of approximately 7 to 100 nm adhering to the surfaces of the mother particles. Therefore, when such toner is applied with a stress, the external additive may drop out of the mother particles or may be buried under the surfaces of the mother particles, with the result that the mother particles tend to adhere to each other. For this reason, the waste toner (subject to the stress) tends to be agglomerated. In this regard, the agglomerated particles (the waste toner) are more likely to be separated from each other by external force (for example, agitation) compared with agglomerated toner due to thermal fusion bonding. Such agglomeration of the waste toner is referred to as "soft agglomeration".

Figure 7:
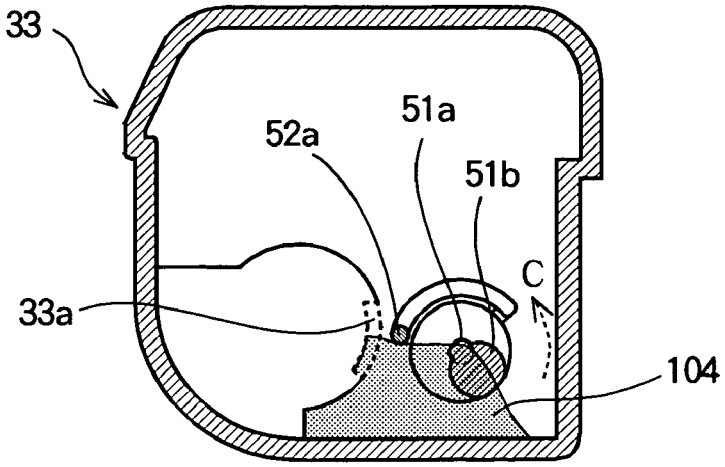
FIG. 7 is a sectional view taken along line 7-7 in FIG. 4 for illustrating a process for carrying the toner according to Embodiment 1.
Figure 8:
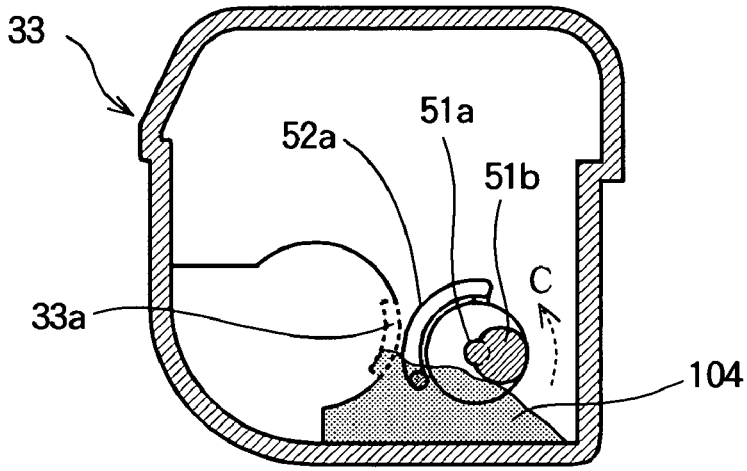
FIG. 8 is a sectional view taken along line 7-7 in FIG. 4 for illustrating the process for carrying the toner according to Embodiment 1.
Figure 9:
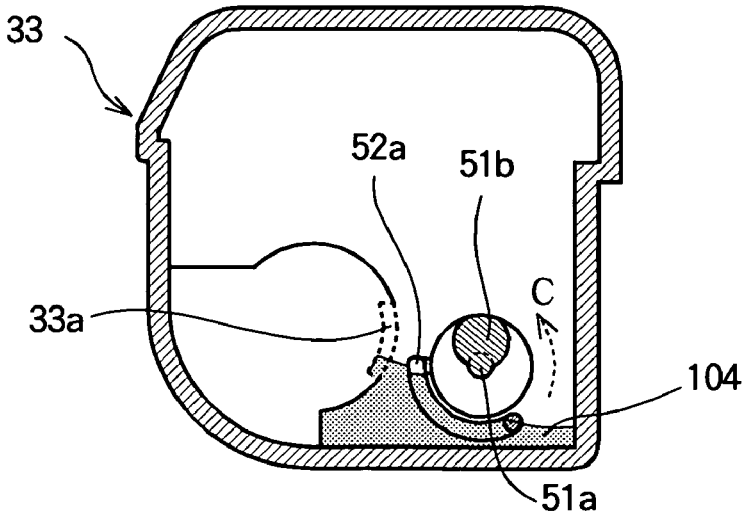
FIG. 9 is a sectional view taken along line 7-7 in FIG. 4 for illustrating the process for carrying the toner according to Embodiment 1.
Figure 10:
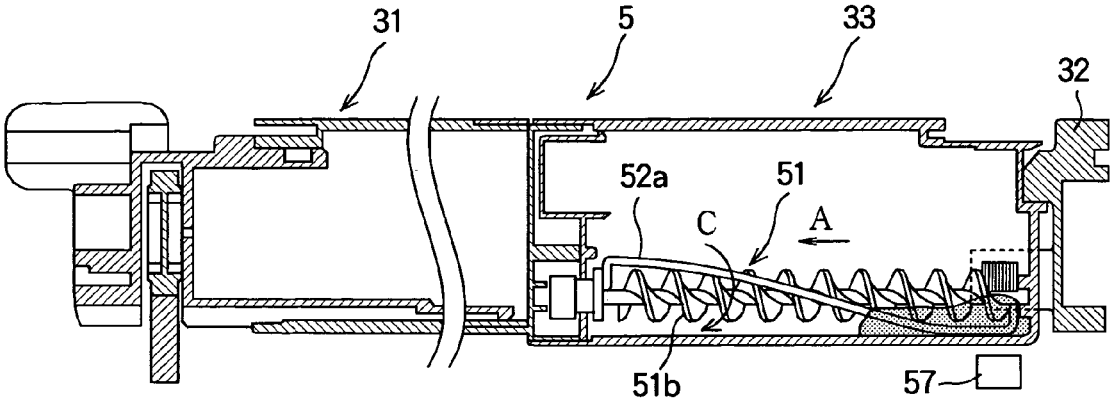
FIG. 10 is a longitudinal sectional view taken in a similar manner to FIG. 4 for illustrating the process for carrying the toner according to Embodiment 1.
Figure 11:
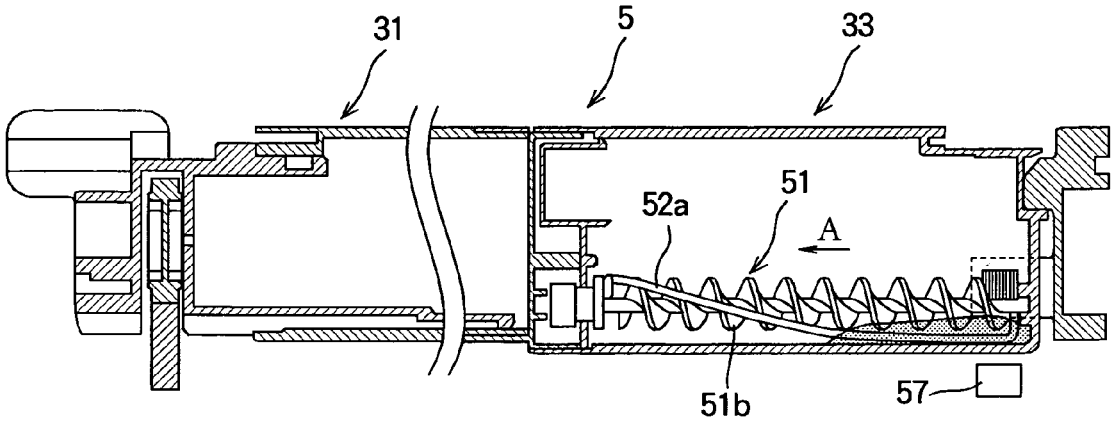
FIG. 11 is a longitudinal sectional view taken in a similar manner to FIG. 4 for illustrating the process for carrying the toner according to Embodiment 1.
Figure 12:
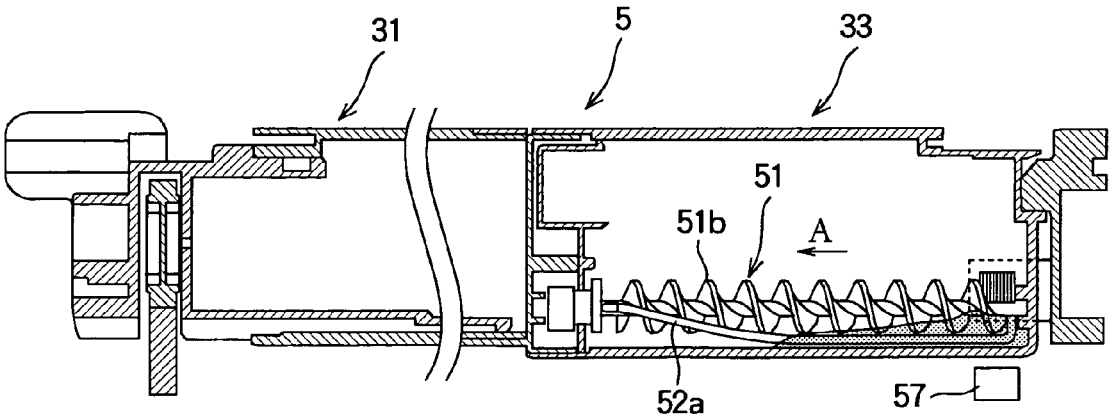
FIG. 12 is a longitudinal sectional view taken in a similar manner to FIG. 4 for illustrating the process for carrying the toner according to Embodiment 1.

Next, an operation of the toner storing portion 33 of the toner cartridge 5 will be described with reference to FIGS. 7 through 12. FIGS. 7 through 9 are sectional views taken along line 7-7 in FIG. 4 (i.e., relatively close to the toner collection opening 33*a*) for illustrating respective processes of carrying the waste toner. FIGS. 10 through 12 are longitudinal sectional views taken in a similar manner to FIG. 4 for illustrating the processes corresponding to FIGS. 7 through 9. In FIGS. 10 through 12, the driving force transmitting shaft 63, the intermediate gear 61 and the coupling gear 62 are omitted for sake of simplicity.

When the toner carrying member 51 receives the driving force transmitted from the driving source (not shown) of the image forming apparatus 100, and the shaft portion 51*a* rotates in the direction shown by arrow C, the waste toner 104 supplied to the toner storing portion 33 via the toner collection opening 33*a* is carried in a direction shown by arrow A (FIG. 4) by the spiral blade 51*b*. As the waste toner 104 is further supplied to the toner storing portion 33, the waste toner 104 tends to be locally accumulated around the spiral blade 51*b* in the vicinity of the toner collection opening 33*a* as shown in FIG. 7.

In a general toner cartridge, a carrying member may stop carrying waste toner due to an increasing load caused by locally accumulated (and softly agglomerated) waste toner, even if a toner storing portion has not yet been filled with the waste toner. In such a case, it is difficult to store a sufficient amount of waste toner.

However, according to Embodiment 1, the toner cartridge 5 is able to store a sufficient amount of waste toner 104 even when the waste toner 104 is locally accumulated (and softly agglomerated). The reason will be described below.

The soft agglomeration of the waste toner 104 (accumulated as above) may locally occur even when the toner storing portion 33 is not filled with the waste toner 104. If the amount of the accumulated waste toner 104 increases, a load applied to the spiral blade 51*b* increases, which may cause a capacity with which the carrying member 51 carries the waste toner 104 to decrease. However, the agitating portion 52*a* of the agitating member 52 disposed around the spiral blade 51*b* (and extending in a spiral shape) agitates the accumulated waste toner 104 to disentangle the softly agglomerated waste toner 104 as the toner carrying member 51 rotates in the direction indicated by arrow C. That is, the agitating portion 52*a* of the agitating member 52 levels the locally accumulated waste toner 104 from the state shown in FIG. 7 to the state shown in FIG. 9 via the state shown in FIG. 8.

The leveled waste toner 104 is carried by the spiral blade 51*b* in the direction shown by arrow A from the state shown in FIG. 10 to the state shown in FIG. 12 via the state shown in FIG. 11. In this regard, the agitating portion 52*a* extends in a spiral shape so as to generate a force agitating the accumulated waste toner 104 and pushing the waste toner 104 in the direction shown by arrow A. Therefore, the agitating portion 52*a* functions to carry the waste toner 104 as well as the carrying member 51. That is, the agitating member 52 (including the agitating portion 52*a* extending in a spiral shape) agitates and levels the waste toner 104 as shown in FIGS. 7 through 9, and also assists carrying the waste toner 104 in the direction indicated by arrow A as shown in FIGS. 10 through 12.

In this example, the agitating portion 52*a* of the agitating member 52 extends in a spiral shape around the shaft portion 51*a* about a half turn as described above. In this regard, it is preferable that the agitating portion 52*a* of the agitating member 52 extends around the shaft portion 51*a* in a range from ¼ turn (one-fourth of a turn) to two turns. With such a range, the agitating portion 52*a* effectively generates a force agitating the waste toner 104 and a force pushing (carrying) the waste toner 104 in the toner storing portion 33 as described later. To be more specific, if the agitating portion 52*a* extends around the shaft portion 51*a* by less than ¼ turn, the force carrying the waste toner 104 in the direction shown by arrow A (FIG. 4) is insufficient, so that the waste toner 104 is likely to be accumulated in the vicinity of the toner collection opening 33*a*. In contrast, if the agitating portion 52*a* extends around the shaft portion 51 by more then two turns, the force carrying the waste toner 104 in the direction shown by arrow A (FIG. 4) becomes too large, so that the waste toner 104 is likely to be accumulated on the center partition wall 35 side. In both cases, an uneven distribution of the waste toner 104 occurs. Therefore, in order to store the waste toner 104 uniformly in the toner storing portion 33 and to efficiently carry the waste toner 104, it is preferable that the agitating portion 52*a* extends around the shaft portion 51*a* in a range from ¼ turn to two turns.

As described above, according to Embodiment 1, the agitating member 52 includes the agitating portion 52*a* extending in a spiral shape, and therefore the agitating member 52 functions to agitate and level the accumulated waste toner 104, and to assist carrying the waste toner 104 in the direction away from the toner collection opening 33*a*. Therefore, an increase in rotational load on the toner carrying member 51 (due to the accumulation of the waste toner 104 in the vicinity of the toner collection opening 33*a*) can be prevented, and uneven accumulation of the waste toner 104 can be prevented. As a result, a sufficient amount of waste toner 104 can be evenly stored in the toner storing portion 33, and the carrying of the waste toner 104 can be efficiently performed.

Embodiment 2

Figure 13:
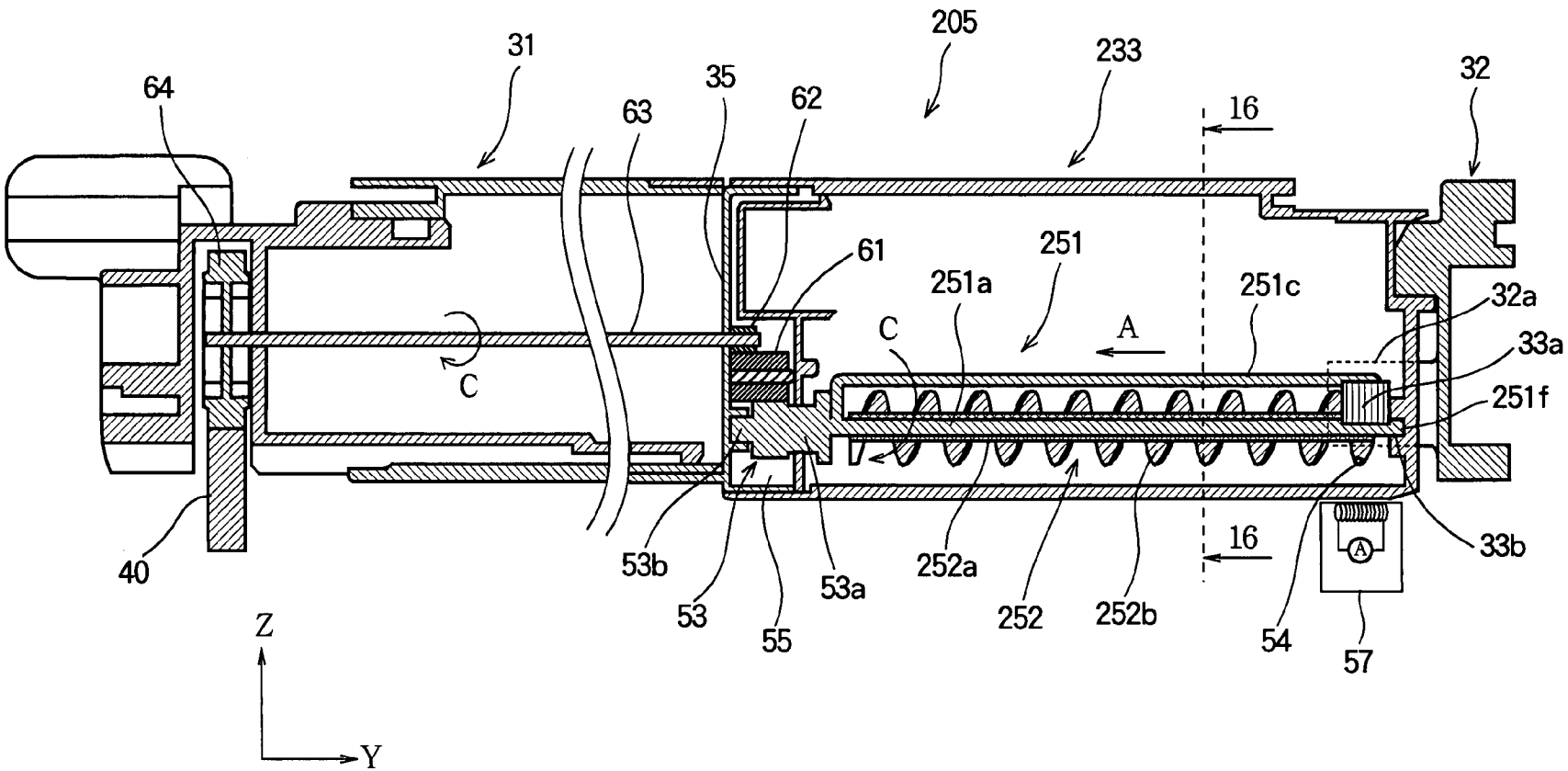
FIG. 13 is a longitudinal sectional view showing a toner cartridge according to Embodiment 2 of the present invention.

FIG. 13 is a sectional view showing a configuration of a toner cartridge 205 including a toner storing portion 233 according to Embodiment 2 of the present invention.

The toner cartridge 205 (i.e., a developer storing apparatus) of Embodiment 2 is different from the toner cartridge 5 of Embodiment 1 (FIG. 5) in configurations of a toner carrying member 251 and a rotation monitoring system for monitoring the rotation of the toner carrying member 251. Components of an image forming apparatus employing the toner cartridge 205 of Embodiment 2 which are the same as those of the image forming apparatus 100 of Embodiment 1 are assigned the same reference numerals or omitted in figures, and explanations thereof are omitted. Explanations will be focused on differences between the image forming apparatus of Embodiments 1 and 2. The image forming apparatus of Embodiment 2 has the same configurations as the image forming apparatus 100 (FIG. 1) of Embodiment 1 except the toner cartridge 205, and therefore FIG. 1 will be referred as necessary.

As shown in FIG. 13, the toner cartridge 205 includes a toner supplying portion 31 and a toner storing portion 233 (i.e., a developer storing portion) adjacent to each other via a center partition wall 35. A toner carrying member 251 is disposed at a lower part inside the toner storing portion 233. A receiving portion (not shown) is disposed in the toner storing portion 233. The receiving portion has a substantially cylindrical shape and the toner collection opening 33*a* is formed thereon. A toner ejecting portion 32*a* of the side frame 32 (FIG. 3) is fit into the receiving portion when the toner cartridge 205 is mounted to the image forming unit main body 23*a* (FIG. 2). The waste toner 104 having been carried by the above described carrying belt or the like is supplied to the toner storing portion 233 via the toner collection opening 33*a* of the receiving portion.

Figure 14A:
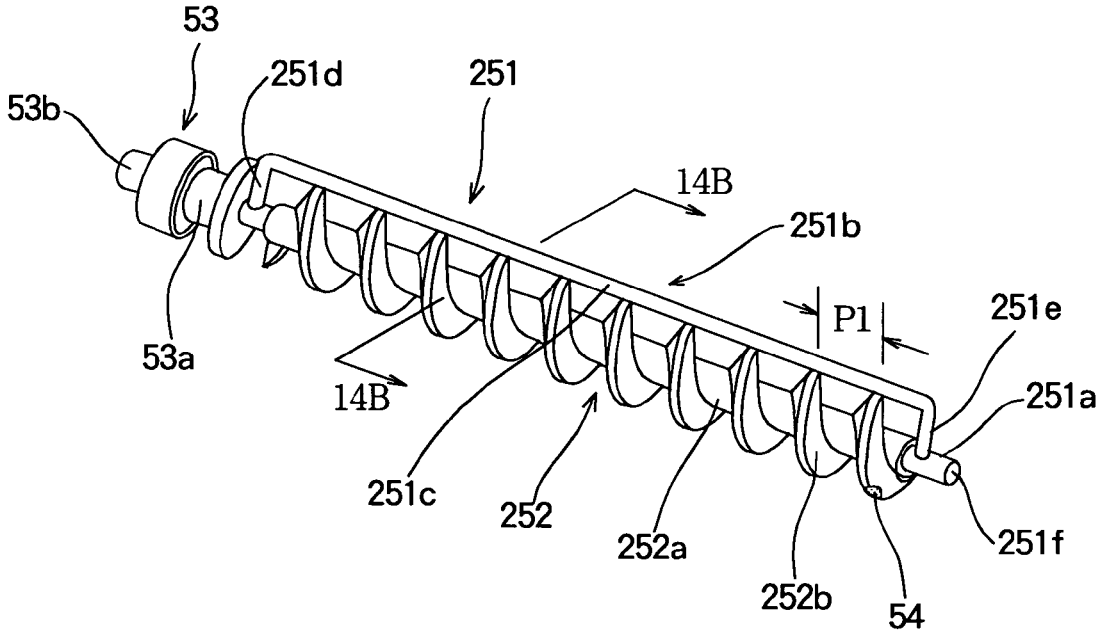
FIG. 14A is a perspective view showing a toner carrying member according to Embodiment 2.
Figure 14B:
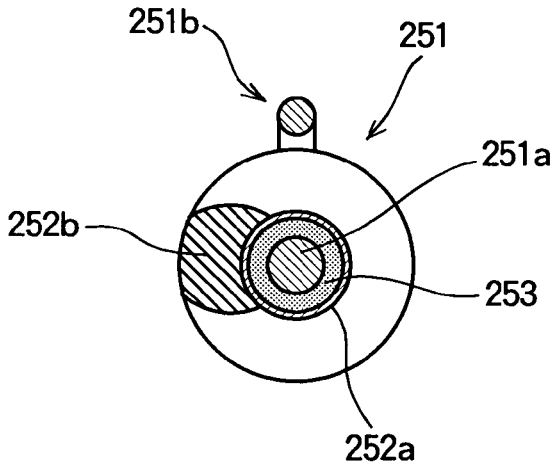
FIG. 14B is a sectional view taken along line 14B-14B in FIG. 14A.

FIG. 14A is a perspective view showing a toner carrying member 251. FIG. 14B is a sectional view of the toner carrying member 251 taken along line 14B-14B in FIG. 14A.

As shown in FIGS. 14A and 14B, the toner carrying member 251 includes a shaft portion 251*a* (i.e., a rotation shaft), a rotation gear 53 disposed on an end of the shaft portion 251*a*, an agitating member 251*b* fixed to the shaft portion 251*a* and a spiral blade member 252 held by the shaft portion 251*a* so as to be slidably rotatable. The rotation gear 53 is provided with shaft-receiving rotating portion 53*a* and 53*b* as was described in Embodiment 1.

The agitating member 251*b* includes a pair of supporting portions 251*d* and 251*e*, disposed in vicinities of both ends of the shaft portion 251*a* and an agitating portion 251*c* (for example, in the form of a bar having a circular cross section) extending between the supporting portions 251*d* and 251*e*. The agitating portion 251*c* extends in an axial direction of the shaft portion 251*a* and apart from the shaft portion 251*a*. The supporting portions 251*d* and 251*e* and the agitating portion 251*c* are continuously configured and integral with each other. The spiral blade member 252 includes a spiral blade holding shaft 252*a* in the form of a pipe through which the shaft portion 251*a* penetrates, and a spiral blade 252*b* formed on the circumferential surface of the spiral blade holding shaft 252*a*. The spiral blade 252*b* has a spiral shape at a predetermined pitch P1. A sponge 253 (FIG. 14B) is disposed between the spiral blade holding shaft 252*a* and the shaft portion 251*a* in a compressed manner. The sponge 253 (i.e., a rotation transmitting member or a friction member) generates a friction between the spiral blade holding shaft 252*a* and the shaft portion 251*a*. A magnet 54 (i.e., a to-be-detected portion) is disposed on an outer circumference of an endmost part of the spiral blade 252*b*. The magnet 54 is detected by a detecting unit as described later for detecting the rotation of the spiral blade member 252. In this regard, the magnet 54 can be disposed on the spiral blade holding shaft 252*a* instead of the spiral blade 252*b*.

The heights of the supporting portions 251*d* and 251*e* are so set that the height of the agitating portion 251*c* of the agitating member 251*b* from the shaft portion 251*a* is higher than the height of the spiral blade 252*b*.

As shown in FIG. 13, a frame 56 is disposed in the toner storing portion 233 so that the frame 56 and the center partition wall 35 form a gear box 55. The shaft-receiving rotating portions 53*b* and 53*a* of the toner carrying member 251 are rotatably supported by the center partition wall 35 and the frame 56. An end 251*f* of the toner carrying member 251 (opposite to the rotation gear 53) is rotatably supported by a shaft-receiving hole 33*b* formed on a side wall of the toner storing portion 233. With such a configuration, the toner carrying member 251 is rotatably supported in the toner storing portion 233 in such a manner that the shaft portion 251*a* is disposed below the toner collection opening 33*a* and the rotation gear 53 is disposed in the gear box 55. Further, the toner carrying member 251 extends in the longitudinal direction of the toner storing portion 233 (i.e., the Y-direction) at the lower part of the toner storing portion 233 so that the end of the spiral blade 252*b* is disposed in the vicinity of the toner collection opening 33*a*.

A driving force transmitting shaft 63 (i.e., a driving force transmitting portion) penetrates through the toner supplying portion 31, and is rotatably supported by the center partition wall 35 and a side wall of the toner supplying opening 31. An end of the driving force transmitting shaft 63 penetrates through the center partition wall 35, and a coupling gear 62 is fixed to the end of the driving force transmitting shaft 63 in the gear box 55. The other end of the driving force transmitting shaft 63 penetrates through the side wall of the toner supplying portion 31, and a cartridge gear 64 is fixed to the end of the driving force transmitting shaft 63 outside the side wall of the toner supplying portion 31.

When the toner cartridge 205 is mounted to the image forming unit main body 23*a* (FIG. 2), the cartridge gear 64 engages a driving gear 40 disposed in the image forming unit main body 23*a*, and receives a driving force (via the driving gear 40) transmitted by a driving source (not shown) via a predetermined transmission path. With this driving force, the cartridge gear 64 rotates in a direction shown by arrow C, so that the driving force transmitting shaft 63 rotates in the same direction. Further, the above described coupling gear 62 (fixed to the end of the driving force transmitting shaft 63) engages an intermediate gear 61 rotatably supported in the gear box 55, and the intermediate gear 61 engages the rotation gear 53 of the toner carrying member 251. With such a configuration, the driving force transmitted from the driving source (not shown) is transmitted to the toner carrying member 251, so that the toner carrying member 251 is driven to rotate in the direction shown by arrow C at a predetermined timing described later.

A rotation detecting unit 57 is disposed in the image forming unit main body 23*a* so as to face the outer surface of the toner storing portion 233. To be more specific, the rotation detecting unit 57 is disposed in the vicinity of a position where the magnet 54 on the endmost part of the spiral blade 252*b* periodically approaches as the spiral blade member 252 rotates in the direction shown by arrow C. The rotation detecting unit 57 detects change in magnetic field when the magnet 54 approaches to the rotation detecting unit 57 to thereby detect the rotation of the spiral blade member 252, and sends a rotation signal to an alarm control unit 301 (FIG. 15) described below.

Figure 15:
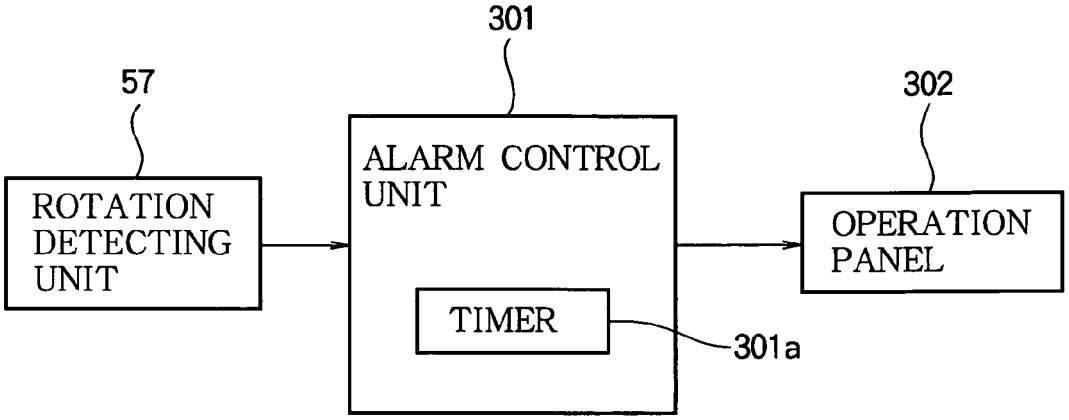
FIG. 15 is a block diagram showing a configuration of a rotation monitoring system including an alarm control unit according to Embodiment 2.

FIG. 15 is a block diagram of a rotation monitoring system including the alarm control unit 301. As shown in FIG. 15, the rotation monitoring system includes the above described rotation detecting unit 57 (see FIG. 13), the alarm control unit 301 and an operation panel 302 disposed on a predetermined position on the image forming apparatus 100 so as to be visible to a user.

The rotation detecting unit 57 sends the rotation signal in synchronization with the rotation of the spiral blade member 252 (for example, a rotation synchronizing pulse signal) to the alarm control unit 301 as described above. The alarm control unit 301 resets a timer 301*a* (provided in the alarm control unit 301) to zero on receiving the rotation synchronizing pulse signal. If the timer 301*a* counts, for example, approximately 24 seconds (corresponding to 30 rotations of the spiral blade member 252) without being reset, the alarm control unit 301 determines that the toner storing portion 233 is filled with the waste toner 104, and sends instruction to the operation panel 302 to display a predetermined alarm message. Based on the instruction, the operation panel 302 causes a predetermined light emitting unit to flash, to notify the user that the toner storing portion 233 is in a filled state.

Figure 16:
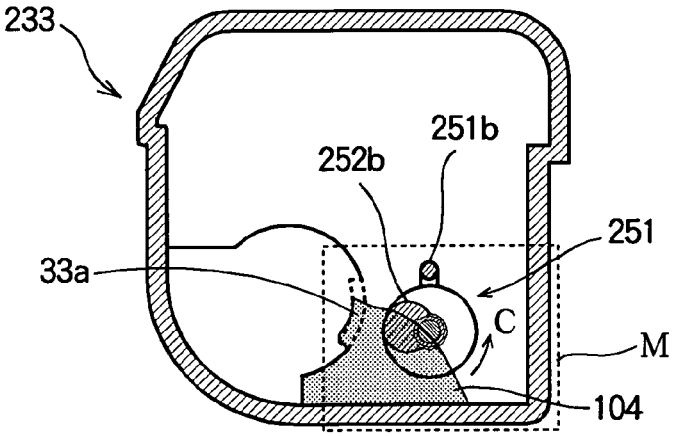
FIG. 16 is a sectional view taken along line 16-16 in FIG. 13 for illustrating a process for carrying the toner according to Embodiment 2.
Figure 17:
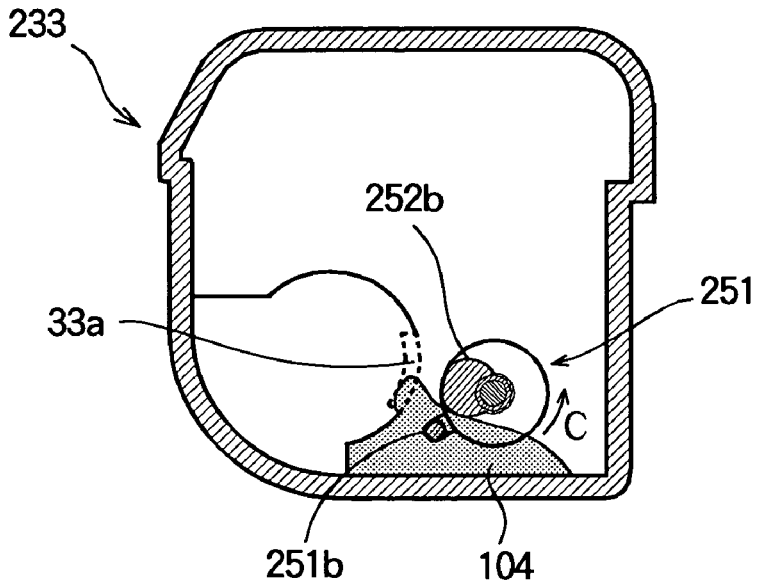
FIG. 17 is a sectional view taken along line 16-16 in FIG. 13 for illustrating the process for carrying the toner according to Embodiment 2.
Figure 18:
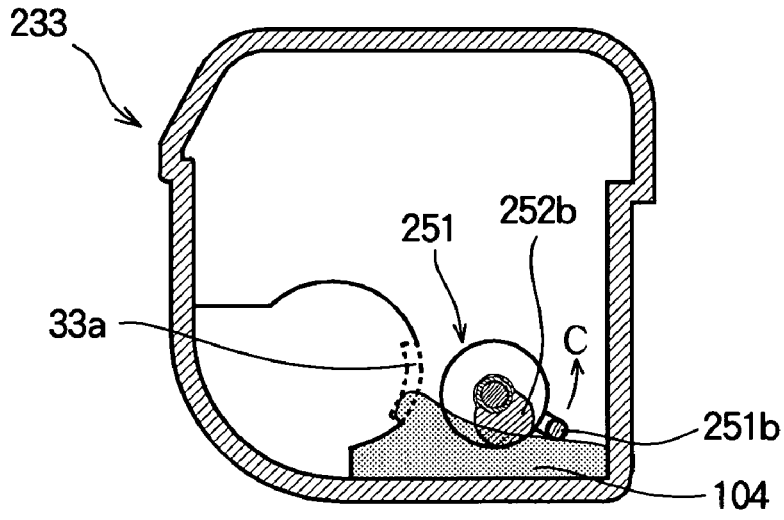
FIG. 18 is a sectional view taken along line 16-16 in FIG. 13 for illustrating a process for carrying the toner according to Embodiment 2.
Figure 19:
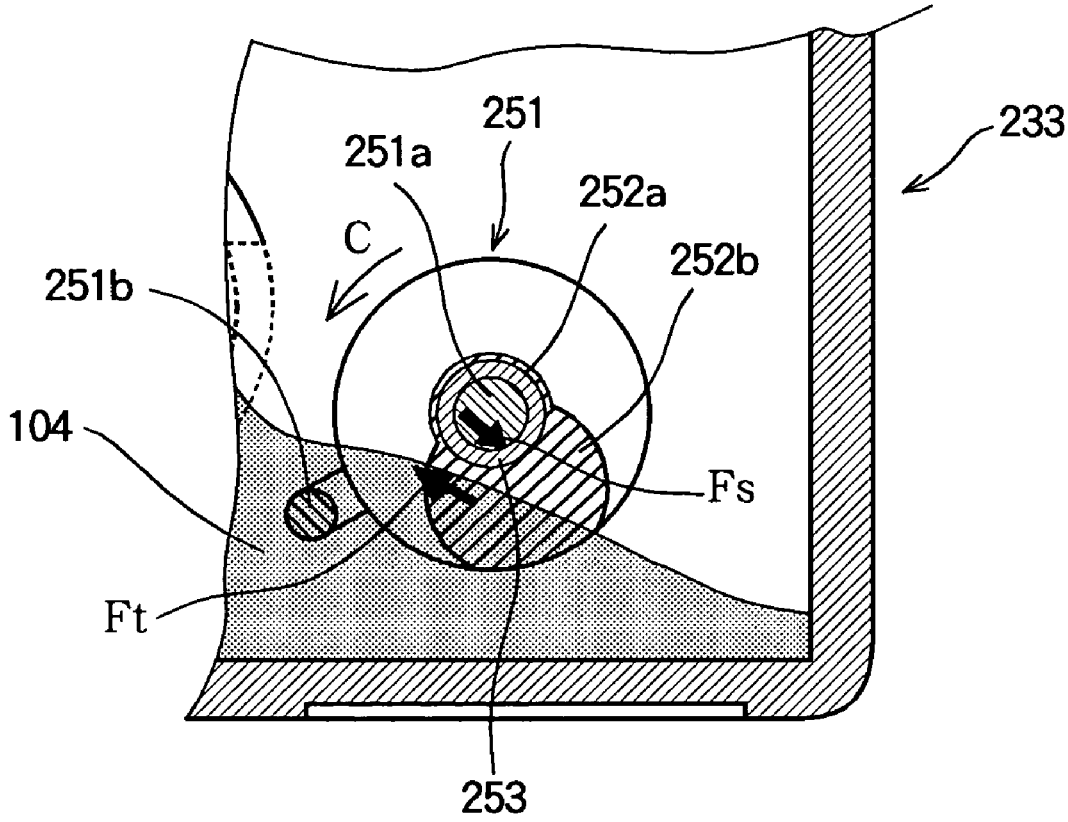
FIG. 19 is an enlarged view of a part (M) shown by a dashed line in FIG. 16.

An operation of the image forming apparatus according to Embodiment 2 will be described. In this regard, the operation of the image forming apparatus except an operation relating to the toner storing portion 233 of the toner cartridge 205 is the same as the operation described in Embodiment 1. Therefore, the operation relating to the toner storing portion 233 will be described with reference to FIGS. 16 through 19. FIGS. 16 through 18 are sectional views taken along line 16-16 in FIG. 13 (i.e., relatively close to the toner collection opening 33*a*) for illustrating respective processes of carrying the waste toner. FIG. 19 is an enlarged view of a part M enclosed by a dashed line in FIG. 16.

When the toner carrying member 251 receives the driving force transmitted from the driving source (not shown) of the image forming apparatus 100, and the shaft portion 251*a* rotates in the direction shown by arrow C, a friction is generated between the shaft portion 251*a* and the spiral blade holding shaft 252*a* due to the sponge 253 (FIG. 14B). With the friction, a driving force Fs (FIG. 19) is applied to the spiral blade member 252 in the direction shown by arrow C, and the spiral blade 252*b* rotates in the same direction shown by arrow C. With the rotation, the waste toner 104 supplied to the toner storing portion 233 via the toner collection opening 33*a* is carried in a direction shown by arrow A (FIG. 13) by the spiral blade 252*b*. As the waste toner 104 is further supplied to the toner storing portion 233, the waste toner 104 tends to be accumulated around the spiral blade 252*b* in the vicinity of the toner collection opening 33*a* as shown in FIG. 16.

As was described in Embodiment 1, the soft agglomeration of the waste toner 104 (accumulated as above) may locally occur even when the toner storing portion 233 is not filled with the waste toner 104. Therefore, if the amount of the accumulated waste toner 104 increases, a load Ft (FIG. 19) applied to the spiral blade 252*b* increases. Further, when the load Ft exceeds the driving force Fs, the shaft portion 251*a* rotates idle, and the rotation of the spiral blade member 252 is stopped.

However, even when the rotation of the spiral blade member 252 is stopped, the shaft portion 251*a* and the agitating member 251*b* (fixed to the shaft portion 251*a*) continue to rotate. Therefore, the agitating member 251*b* levels the locally accumulated waste toner 104. As the waste toner 104 is leveled by the agitating member 251*b*, the load Ft applied to the spiral blade 252*b* gradually decreases. When the load Ft becomes smaller than the driving force Fs, the spiral blade member 252 restarts rotation, so that the waste toner 104 is carried by the spiral blade 252*b* in the direction shown by arrow A.

Further, if the toner storing portion 233 is filled with the waste toner 104, the load Ft applied to the spiral blade 252*b* stays exceeding the driving force Fs of the spiral blade member 252, and the rotation of the spiral blade member 252 is stopped. In this case, the alarm control unit 301 (FIG. 15) does not receive the rotation synchronizing signal from the rotation detecting unit 57 (that detects the rotation of the spiral blade member 252) for a predetermined time period or more. In such a case, when the alarm control unit 301 does not receive the rotation synchronizing signal for a predetermined time period, the alarm control unit 301 sends instruction to the operation panel 302 to display the predetermined alarm message. Based on the instruction, the operation panel 302 causes the predetermined light emitting unit to flash, to notify the user that the toner storing portion 233 is in a filled state.

In the above description, the time period after the rotation of the spiral blade member 252 is stopped and before the alarm message is displayed is approximately 24 seconds. However, it is possible that the time period can be arbitrarily set in accordance with conditions of the toner cartridge 205 or the like.

Further, in the above description, the sponge 253 is used to generate a friction to transmit the rotation of the shaft portion 251*a* to the spiral blade member 252. However, it is also possible to employ other configuration. For example, it is possible to utilize meshing or engagement between elements. Further, although the rotation of the spiral blade member 252 is detected magnetically, it is also possible to detect the rotation of the spiral blade member 252 electrically or optically, or utilizing free-fall of an element or the like.

As described above, according to Embodiment 2, the agitating member 251 is provided with the agitating portion 251*b*, and therefore the agitating member 251 carry the waste toner 104 while agitating the waste toner 104. Therefore, an increase in rotational load on the toner carrying member 251 (due to the accumulation of the waste toner 104 in the vicinity of the toner collection opening 33*a*) is prevented, and uneven accumulation of the waste toner 104 can be prevented. As a result, a sufficient amount of waste toner 104 can be evenly stored evenly in the toner storing portion 233.

In addition, the rotation of the spiral blade member 252 is stopped when the toner storing portion 233 is filled with the waste toner 104. Therefore, by monitoring the rotation of the spiral blade member 252, it is possible to notify the user that the toner storing portion 233 is filled with the waste toner 104 at a suitable timing.

Embodiment 3

Figure 20A:
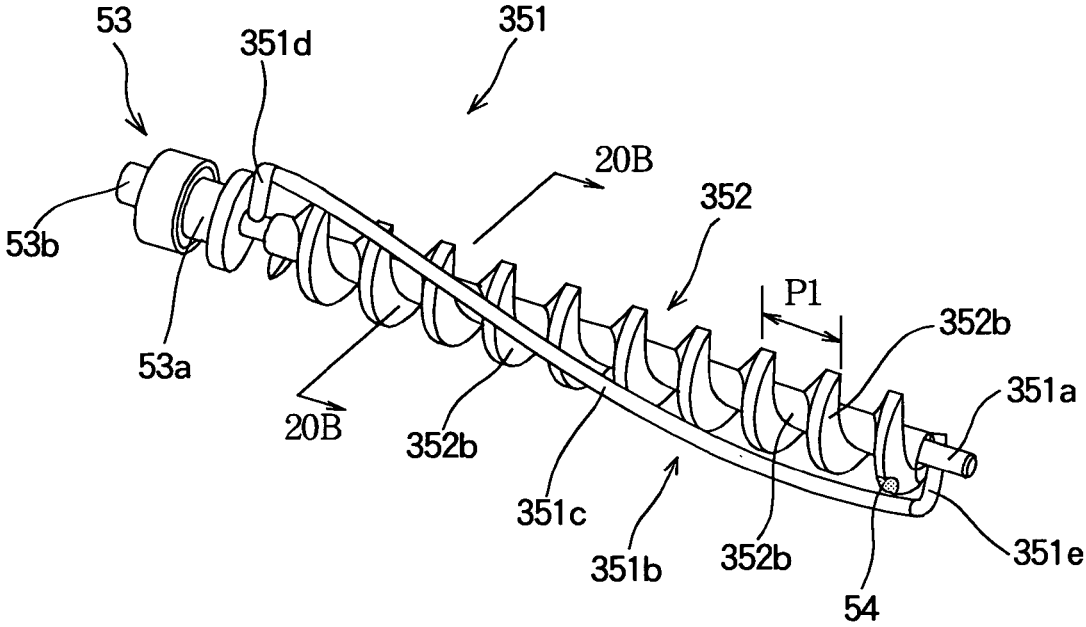
FIG. 20A is a perspective view showing a toner carrying member according to Embodiment 3 of the present invention.
Figure 20B:
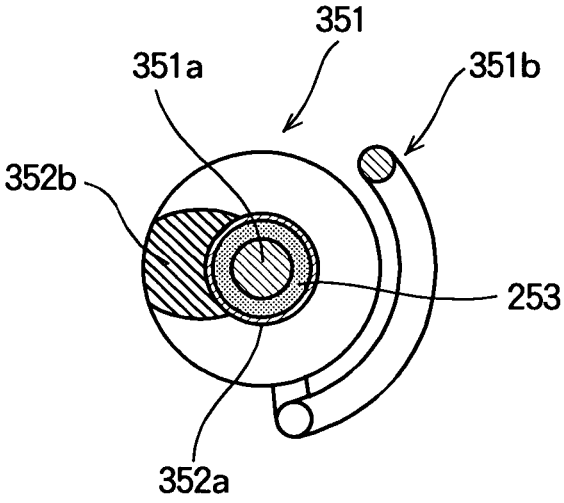
FIG. 20B is a sectional view taken along line 20B-20B in FIG. 20A.

FIG. 20A is a perspective view showing a toner carrying member 351 used in a toner cartridge according to Embodiment 3. FIG. 20B is a sectional view of the toner carrying member 351 taken along line 20B-20B in FIG. 20A.

Components of an image forming apparatus employing the toner carrying member 351 of Embodiment 3 which are the same as those of the image forming apparatus 100 of Embodiment 1 are assigned the same reference numerals or omitted in figures, and explanations thereof are omitted. Explanations are focused on differences between the image forming apparatus of Embodiments 1 and 3. A toner cartridge (i.e., a developer storing apparatus) of Embodiment 3 has the same configurations as the toner cartridge 205 (FIG. 13) of Embodiment 2 except a structure of the toner carrying member 351, and therefore FIG. 13 will be referred as necessary.

As shown in FIGS. 20A and 20B, the toner carrying member 351 includes a shaft portion 351*a* (i.e., a rotation shaft), a rotation gear 53 disposed on an end of the shaft portion 351*a*, an agitating member 351*b* fixed to the shaft portion 351*a* and a spiral blade member 352 held by the shaft portion 351*a* so as to be slidably rotatable. The rotation gear 53 is provided with shaft-receiving rotating portion 53*a* and 53*b* as was described in Embodiment 1. That is, the toner carrying member 351 includes features of the toner carrying member 51 of Embodiment 1 (FIG. 5) and the toner carrying member 251 of Embodiment 2 (FIG. 14).

The spiral blade member 352 has the same structure as the spiral blade member 252 shown in FIG. 14, i.e., includes a spiral blade holding shaft 352*a* in the form of a pipe through which the shaft portion 351*a* penetrates, and a spiral blade 352*b* formed on the circumferential surface of the spiral blade holding shaft 352*a*. The spiral blade 352*b* has a spiral shape at a predetermined pitch P1.

The agitating member 351*b* (fixed to the shaft portion 351*a*) includes a pair of supporting portions 351*d* and 351*e* disposed in vicinities of both ends of the shaft portion 351*a*, as is the case with the agitating member 52 shown in FIG. 5. The supporting portions 351*d* and 351*e* are shifted 180 degrees from each other in a rotational direction about the shaft portion 351*a*. The supporting portions 351*d* and 351*e* have predetermined heights from the shaft portion 351*a* and extend in the radial direction of the shaft portion 351*a*. An agitating portion 351*c* (for example, in the form of a bar having a circular cross section) is supported by tips of the supporting portions 351*d* and 351*e*, and extends between the supporting portions 351*d* and 351*e* apart from the shaft portion 351*a*. To be more specific, the agitating portion 351*c* extends in a spiral shape around the shaft portion 351*a* about a half turn in the rotational direction about the shaft portion 351*a*. In this regard, it is preferable that the agitating portion 351*c* of the agitating member 351*b* extends around the shaft portion 351*a* in a range from ¼ turn to two turns. A sponge 253 (FIG. 20B) is disposed between the spiral blade holding shaft 352*a* and the shaft portion 351*a* in a compressed manner. The sponge 253 (i.e., a rotation transmitting member, or a friction member) generates a friction between the spiral blade holding shaft 352*a* and the shaft portion 351*a*. A magnet 54 (i.e., to-be-detected portion) is disposed on an outer circumference of an endmost part of the spiral blade 352*b*. The magnet 54 is detected as described later for detecting the rotation of the spiral blade member 352. In this regard, the magnet 54 can be disposed on the spiral blade holding shaft 352*a* instead of the spiral blade 352*b*.

The heights of the supporting portions 351*d* and 351*e* are so set that the height of the agitating portion 351*c* of the agitating member 351*b* from the shaft portion 351*a* is higher than the height of the spiral blade 352*b*.

A carrying operation of the waste toner 104 by the toner carrying member 351 according to Embodiment 3 will be described.

When the toner carrying member 351 receives the driving force transmitted from the driving source (not show) of the image forming apparatus 100, and the shaft portion 351*a* rotates in the direction shown by arrow C, a friction is generated between the shaft portion 351*a* and the spiral blade holding shaft 352*a* due to the sponge 253 (FIG. 20B). With the friction, a driving force Fs (see FIG. 19) is applied to the spiral blade member 352 in the direction shown by arrow C, and the spiral blade 352*b* rotates in the same direction shown by arrow C. With the rotation, the waste toner 104 supplied to the toner storing portion 233 (FIG. 13) via the toner collection opening 33*a* is carried in a direction shown by arrow A (FIG. 13) by the spiral blade 352*b*.

When the shaft portion 351*a* and the spiral blade member 352 rotate together with each other due to the action of the sponge 253 (i.e., the friction member), the toner carrying member 351 operates in a similar manner to the toner carrying member 51 (FIG. 5A) of the toner cartridge 5 (FIG. 4) of Embodiment 1. In other words, the agitating member 351*b* (including the agitating portion 351*c* in the spiral shape) functions to level the waste toner 104 and functions to carry the waste toner in the direction shown by arrow A.

When the amount of the accumulated waste toner 104 increases, and a load Ft applied to the spiral blade 352*b* exceeds the driving force Fs, the shaft portion 351*a* rotates idle, and the rotation of the spiral blade member 352 is stopped. However, as was described in Embodiment 2, the shaft portion 351*a* and the agitating member 351*b* (fixed to the shaft portion 351*a*) continue to rotate, and level the accumulated waste toner 104. As the waste toner 104 is leveled by the agitating member 351*b*, the load Ft applied to the spiral blade 352*b* gradually decreases. When the load Ft becomes smaller than the driving force Fs, the spiral blade member 352 restarts rotation, so that the waste toner 104 is carried by the spiral blade 352*b* in the direction shown by arrow A.

Further, when the toner storing portion 233 (FIG. 13) is filled with the waste toner 104, and the rotation of the spiral blade member 352 is kept being stopped for a predetermine time period, the alarm control unit 301 (FIG. 15) sends instruction to the operation panel 302 to display a predetermined alarm message, and the operation panel 302 notifies the user that the toner storing portion 233 is in the filled state, as was described in Embodiment 2.

As described above, according to Embodiment 3, the agitating member 351 (including the agitating portion 351*c* extending in a spiral shape) functions to agitate and level the accumulated waste toner 104, and to assist carrying the waste toner 104 in the direction away from the toner collection opening 33*a*. Therefore, an increase in rotational load on the toner carrying member 351 (due to the accumulation of the waste toner 104 in the vicinity of the toner collection opening 33*a*) is prevented, and uneven accumulation of the waste toner 104 can be prevented. As a result, a sufficient amount of waste toner 104 can be evenly stored in the toner storing portion 233, and the carrying of the waste toner 104 can be efficiently performed.

In addition, the rotation of the spiral blade member 352 is stopped when the toner storing portion 233 is filled with the waste toner 104. Therefore, by monitoring the rotation of the spiral blade member 352, it is possible to notify the user that the toner storing portion 233 is filled with the waste toner at a suitable timing.

In the above described embodiments, the agitating portion 52*a* (251*c*, 351*c*) has been described as being composed of a bar having a circular cross section. However, the agitating member is not limited to such structure, and various modifications can be made. For example, it is also possible that the agitating member has, for example, triangular cross section, square cross section, polygonal cross section or the like. Further, two or more agitating members can be used.

In the above described embodiment, the image forming apparatus has been described as having a function as a printer. However, the present invention is not limited to such an image forming apparatus, but can be applicable to, for example, a facsimile apparatus, a copier, an MFP (Multiple Function Peripherals) or the like.

While the preferred embodiments of the present invention have been illustrated in detail, it should be apparent that modifications and improvements may be made to the invention without departing from the spirit and scope of the invention as described in the following claims.

What is claimed is:

1. A developer storing apparatus comprising:

a developer storing portion for receiving and storing a developer;

a developer carrying member rotatably disposed in said developer storing portion and configured to carry said developer in said developer storing portion in a predetermined direction, said developer carrying member including a rotation shaft and a spiral blade having a spiral shape and formed on a circumferential surface of said rotation shaft;

an agitating member rotatably disposed in said developer storing portion and configured to agitate said developer in said developer storing portion, said agitating member including an agitating portion extending outside said spiral blade, and a driving force transmitting portion that transmits a driving force to said rotation shaft of said developer carrying member, wherein said agitating portion extends in a spiral shape wound in the same direction as the spiral blade.

2. The developer storing apparatus according to claim 1, wherein said agitating member comprises a pair of supporting portions disposed on said rotation shaft, wherein said agitating portion extends between said pair of supporting portions, said agitating portion being apart from said rotation shaft by a predetermined distance in a radial direction of said rotation shaft, and said agitating portion extending in a spiral shape at a height higher than said spiral blade.

3. The developer storing apparatus according to claim 2, wherein said agitating portion has a spiral pitch which is larger than a spiral pitch of said spiral blade.

4. The developer storing apparatus according to claim 2, wherein said pair of supporting portions are formed in vicinities of both ends of said spiral blade.

5. The developer storing apparatus according to claim 2, wherein said agitating portion is wound around said rotation shaft substantially in a range from ¼ turn to two turns.

6. The developer storing apparatus according to claim 1, wherein said agitating member and said developer carrying member are integral with each other.

7. An image forming unit comprising said developer storing apparatus according to claim 1.

8. An image forming apparatus comprising said developer storing apparatus according to claim 1.

9. A developer storing apparatus comprising:

a developer storing portion for receiving and storing a developer;

a developer carrying member rotatably disposed in said developer storing portion and configured to carry said developer in said developer storing portion in a predetermined direction, said developer carrying member including a rotation shaft and a spiral blade having a spiral shape and formed on a circumferential surface of said rotation shaft;

an agitating member rotatably disposed in said developer storing portion and configured to agitate said developer in said developer storing portion, said agitating member including an agitating portion extending outside said spiral blade and extending straightly parallel to said rotation shaft, and a driving force transmitting portion that transmits a driving force to said rotation shaft of said developer carrying member.

10. A developer storing apparatus comprising:

a developer storing portion for receiving and storing a developer;

a developer carrying member rotatably disposed in said developer storing portion and configured to carry said developer in said developer storing portion in a predetermined direction, said developer carrying member including:

a rotation shaft rotated by said driving force transmitting portion;

a spiral blade holding shaft in the form of a pipe through which said rotation shaft penetrates;

a rotation transmitting member that transmits a rotational force between said rotation shaft and said spiral blade holding shaft, and a spiral blade formed on a circumferential surface of said spiral blade holding shaft at a predetermined pitch;

an agitating member rotatable disposed in said developer storing portion and configured to agitate said developer in said developer storing portion, said agitating member including:

a pair of supporting portions disposed on said rotation shaft, and an agitating portion extending between said pair of supporting portions, said agitating portion being apart from said rotation shaft by a predetermined distance in a radial direction of said rotation shaft, and said agitating portion extending at a height higher than said spiral blade; and a driving force transmitting portion that transmits a driving force to said developer carrying member.

11. The developer storing apparatus according to claim 10, wherein said rotation transmitting member includes a friction member disposed between said rotation shaft and said spiral blade holding shaft so as to cause a friction between said rotation shaft and said spiral blade holding shaft.

12. The developer storing apparatus according to claim 10, wherein said agitating member is so configured that said agitating portion extends parallel to said rotation shaft.

13. The developer storing apparatus according to claim 10, wherein said agitating member is so configured that said agitating portion extends in a spiral shape around said rotation shaft.

14. The developer storing apparatus according to claim 10, wherein one of said spiral blade and said spiral blade holding shaft is provided with a to-be-detected portion which is detected in order to detect a rotation of said spiral blade or said spiral blade holding shaft.

* * * * *